US005275384A

United States Patent [19]

Stomp et al.

[11] Patent Number: 5,275,384

[45] Date of Patent: Jan. 4, 1994

[54] DRIVE FOR AUTOMATIC LANCE CHANGE DEVICES

[75] Inventors: Hubert Stomp, Howald; Daniel Fries, Arlon; Serge Devillet, Burden, all of Luxembourg

[73] Assignee: Paul Wurth S.A., Luxembourg

[21] Appl. No.: 960,509

[22] Filed: Oct. 13, 1992

[30] Foreign Application Priority Data

Oct. 14, 1991 [LU] Luxembourg ..... 88 017

[51] Int. Cl.[5] ..... C21C 5/46

[52] U.S. Cl. ..... 266/226

[58] Field of Search ..... 266/226

[56] References Cited

U.S. PATENT DOCUMENTS 5,037,069 8/1991 Stomp et al. ..... 266/226

5,167,904 12/1992 Stomp et al. ..... 266/226

*Primary Examiner*—Melvin J. Andrews

*Attorney, Agent, or Firm*—Fishman, Dionne & Cantor

[57] ABSTRACT

The present invention relates to drives for an automatic lance-changing devices. In accordance with the present invention, the drive effects the coupling of lances used for supplying media by pressing them against a coupling head which, in turn, is accomplished by draw rods which are operated with the aid of lifting spindle movement transmitting screw thread systems. Each draw rod has associated with it its own reduction gear unit which has an integrated lifting spindle system and on which a load cell is mounted. The primary shafts, in alignment with one another, of the two gear units are connected together by a coupling which compensates for axial, radial and angular displacements.

7 Claims, 2 Drawing Sheets

DRIVE FOR AUTOMATIC LANCE CHANGE DEVICES

TECHNICAL FIELD

The present invention relates to drives for automatic lance change devices. More particularly, this invention relates to drives for lances which in the production of steel by a top blowing process have to be coupled and fastened to a vertically movable lance carriage, in which devices the lances are pressed against a coupling head, in order to couple them thereto, by a drive motor with the aid of two draw rods operated by means of lifting spindle movement transmitting screw thread systems, each of said movement transmitting screw thread systems being formed between the top end of said draw rods and a respective gear wheel of a reduction gear system for the draw rod drive, while a load cell is associated with each lifting spindle system for the purpose of switching off the drive motor when a determined contact pressure value between the lance and the coupling head is reached.

BACKGROUND OF THE INVENTION

An automatic lance change device of the above mentioned kind is described in U.S. patent application, Ser. No. 07/843,129, inventor Hubert Stomp, assigned to Paul Wurth S. A., a Corporation of Luxembourg, hereinafter the '129 document which is specifically incorporated by reference herein.

In the device according to the '129 document, the coupling to the above mentioned lance carriage is effected with the aid of two lifting spindle systems, an external screw thread of a draw rod cooperating in each case with an internal screw thread in the bore of a gear wheel.

These gear wheels may be horizontally disposed wheels in the form of worm wheels, chain wheels, bevel gears, spiral-toothed gears or cogged-belt gears and others, which are mounted axially/radially by their hubs in a gear casing.

In the '129 document, worm wheels were shown by way of illustration in the pertaining figures and worms disposed on a common shaft were associated with them. In this connection the remark was added that these worms may however also be mounted on individual shafts which are connected together by means of a coupling for synchronous driving.

Although the overall concept of the device described in the '129 document constituted a substantial advance in relation to the prior art at the time, a disadvantage exist in that the two worm/worm wheel pairs (or pairs of any other gear wheels, as described hereinabove) are housed in a common casing, so that a gear unit of this type must obviously be specially produced. This common casing also entails the risk that displacements, which in practical operation are entirely possible, will result in the tilting of the two lifting spindle systems, with their possible destruction. Even the optional provision of a coupling, which is also mentioned, changes nothing in this respect as long as the two worm and worm wheel pairs are mounted and housed in a rigid common casing. An important reason for the provision of a coupling, however, is that a coupling enables the angle of rotation of the two worm shafts to be mutually adjusted on assembly, in order to ensure that the two lifting spindle systems will work with optimum synchronism, so that when the drive motor is automatically switched off these systems will press the lance against the coupling head with as precisely equal a force as possible on both sides.

SUMMARY OF THE INVENTION

The above discussed and other problems and deficiencies of the prior art are overcome or alleviated by the present invention, a drive for automatic lance change device for lances which in the production of steel by a top blowing process have to be coupled and fastened to a vertically movable lance carriage. In accordance with the present invention, the lances are pressed against a coupling head and in order to couple them thereto, a drive motor is provided along with the aid of two draw rods operated by means of lifting spindle movement transmitting screw thread systems. Each of the movement transmitting screw thread systems being formed between the top end of said draw rods and a respective gear wheel of a reduction gear systems for the draw rod drive while a load cell is associated with each lifting spindle system for the purpose of switching off the drive motor when a determined contact pressure value between lance and coupling head is reached.

In order to avoid the above mentioned disadvantages of the prior art, it is therefore an object of the present invention to provide a drive of the type mentioned above, which no longer contains special gear units and in which mutual displacements of the two gear wheel pairs no longer entail any impairment of operating reliability.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
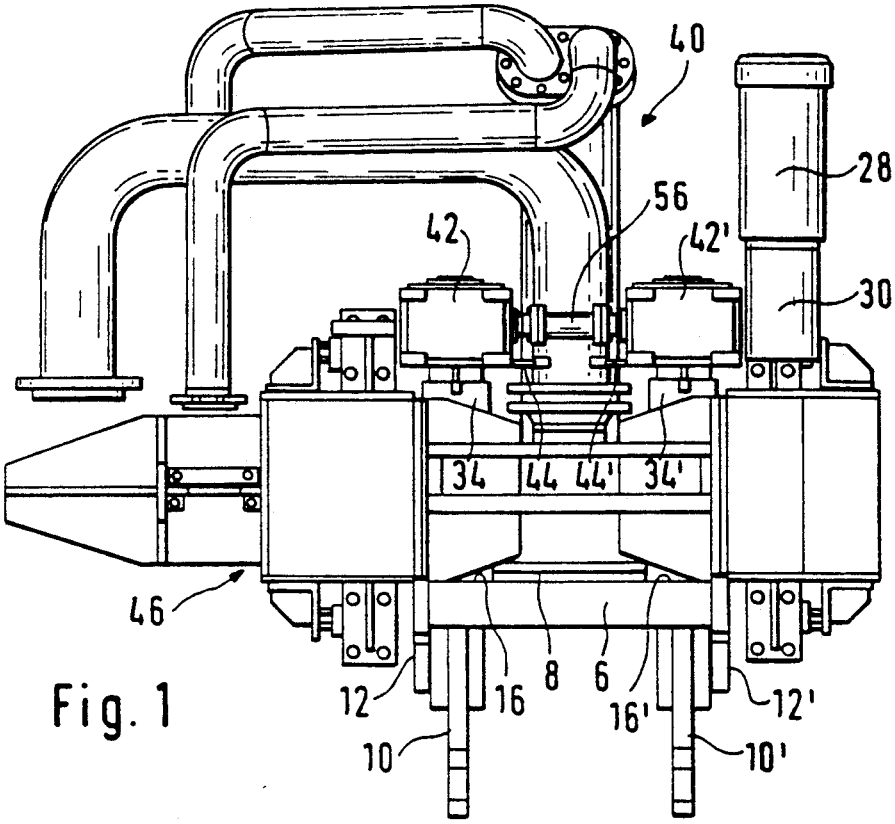
FIG. 1 is a front view of the drive according to the present invention (for the sake of simplicity without the lance suspended in position)

FIG. 1 shows the essential parts of the drive of the present invention for automatic lance change devices, and in it, to simplify cross-reference, parts taken over from the prior art (FIG. 1 of the '129 document) have been given the same reference numerals as in the latter (see in particular parts six (6) through forty (40) in the accompanying FIG. 1 of the '129 document).

Figure 2:
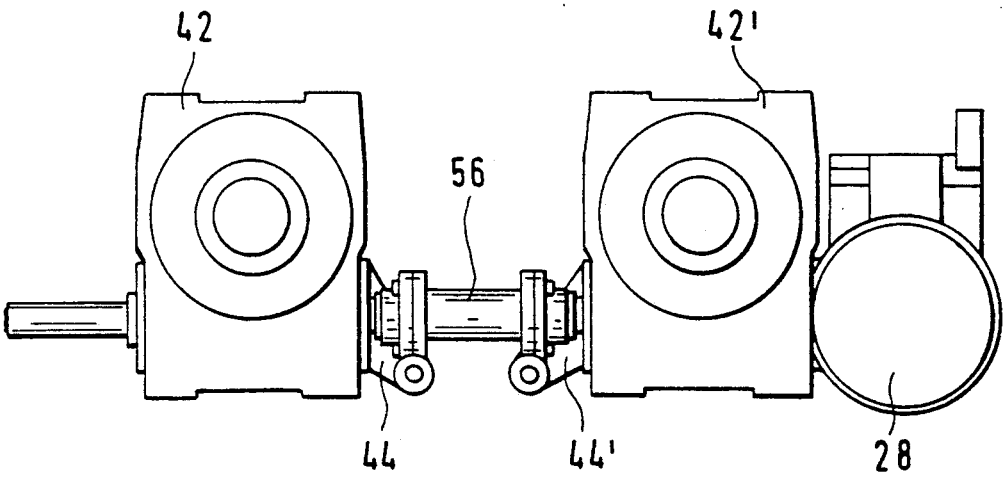
FIG. 2 is a plan view of the essential parts of the object shown in FIG. 1.

In this connection it is relevant that each draw rod 16, 16' has associated with it an individual reduction gear unit 42 and 42' respectively, preferably being worn gear units, that is to say a reduction unit housed in its own casing, each gear unit being mounted on a load cell 34 and 34' respectively. The gear units 42, 42' are secured against rotation by torque struts 44 and 44' respectively, which are supported on the carriage 46 of the lance change device (see also FIGS. 2 and 3).

In the preferred embodiment illustrated the two gear units 42' and 42 are driven by an electric motor 28 through a push-on angular reduction gear unit 30 which is connected to the output of the motor and whose output shaft (not explicitly illustrated) is pushed onto the primary shaft of the worm gear unit 42'.

Figure 3:
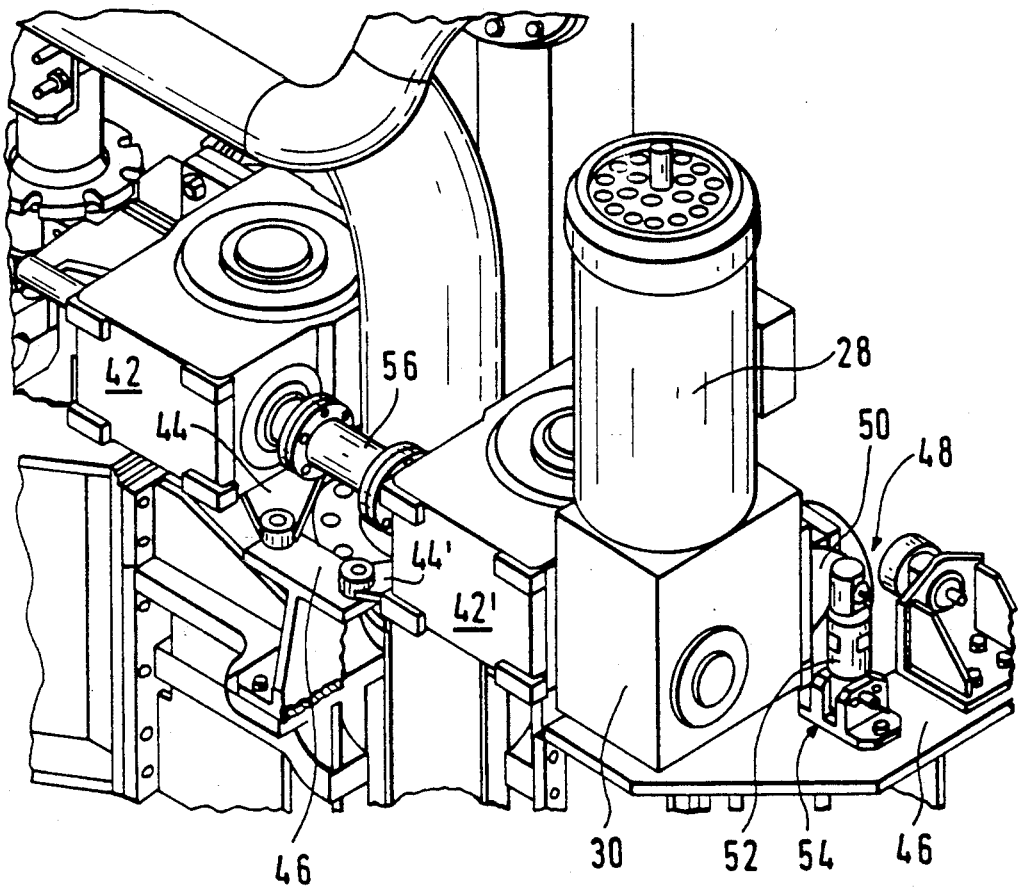
FIG. 3 is a view in perspective of the essential parts of the object shown in FIG. 1.

The torque support needed in an arrangement of this kind is illustrated in its configuration 48 according to the present invention in FIG. 3. The usual torque strut 50 on a push-gear unit 30 of this kind is here supported via an elastic buffer member 52 on a load cell system 54 (or the like, such as for example a torque measuring hub), not explicitly illustrated.

The load cell system 54 is used to switch off the drive motor 28, independently of signals supplied by the load cells 34, 34', when determined critical torque values are reached in the drive chain, although before the load cell system 54 is loaded these values are elastically damped by the buffer member 52 in order to avoid excessively spontaneous response of this system 54.

The two primary shafts of the two identical gear units 42' and 42, which are of the usual commercially available type, are connected together via a coupling 56 such that the primary shaft input side of the gear unit 42 is driven by the primary shaft output side of the gear unit 42'.

In accordance with the present invention the coupling 56 permits mutual displacements, which during assembly and in practical operation are always possible, between the two gear units 42 and 42', so that such displacements can no longer cause serious damage in the drive system.

The present invention therefore provides a coupling 56 which permits axial, radial and angular displacements between the gear units 42 and 42' or their primary shafts.

Among the numerous couplings available on the market for such requirements, the so-called curved tooth couplings are suitable for example.

A coupling of the type mentioned permits cardanic displacements of the two shafts coupled together and, in addition, makes it possible during assembly to make a determined adjustment of the angle of rotation of the two coupled shafts, so that it can be ensured that the two hooks 10, 10' will be raised substantially synchronously and the lance (not shown) will be pressed uniformly on both sides against the coupling head 8, which in the ideal case would be equivalent to a simultaneous stop command from the two load cells 34, 34' to the drive motor 28.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A drive for an automatic lance change device comprising:

a vertically movable lance carriage;

a drive motor;

a pair of reduction gears each mounted to said vertically movable lance carriage and housed in a corresponding casing, each of said reduction gears having an integrated lifting spindle movement transmitting screw thread system which is interconnected with said drive motor, each of said reduction gears including a primary shaft which are in horizontal alignment with one another;

a plurality of draw rods, each of said draw rods being operated by one of said lifting spindle movement transmitting screw thread systems, each of said movement transmitting screw thread systems being formed between a top end of a corresponding one of said draw rods and a corresponding one of said reduction gears, each of said reduction gears being drivingly interconnected with each of said corresponding draw rods;

first load cell means adapted to engage each of said lifting spindle movement transmitting screw thread systems for switching off said drive motor when a determined contact pressure value between a lance and a coupling head is reached, each of said reduction gears mounted on said load cell means; and coupling means connecting said shafts of each of said reduction gears, said coupling means for compensating for axial, radial and angular displacements between said reduction gears.

2. The drive for an automatic lance change drive of claim 1 wherein said reduction reduction gears are supported by torque struts on said carriage.

3. The drive for automatic lance change drive of claim 1 including:

angular prereduction gear means connected to an output of said drive motor.

4. The drive for an automatic lance change drive of claim 3 wherein said angular prereduction gear means comprises:

push-on gear means having a torque strut wherein a hollow output shaft of said push-on gear means is pushed over an input side of said primary shaft of one of said reduction gears.

5. The drive from an automatic lance change drive of claim 4 further comprising:

second load cell means whereon said torque strut is supported, said second load cell means for switching off said drive motor when impermissibly high forces occur thereat.

6. The drive for an automatic lance change drive of claim 5 further comprising:

elastic buffering means disposed between said torque strut and said second load cell means for preventing undesirable spontaneous switching-off of said drive motor.

7. The drive for an automatic lance change drive of claim 4 further comprising:

elastic buffering means disposed on said carriage, said torque strut being supported by said electric buffering means; and limit switch means being actuated by said torque strut when a predetermined torque value is reached.

* * * * *